United States Patent [19]

Hendrix

[11] 4,240,795

[45] Dec. 23, 1980

[54] TREATMENT OF TEXTILES WITH MODIFIED ALPHA-OLEFINS

[75] Inventor: William T. Hendrix, Chester, S.C.

[73] Assignee: Sun Chemical Corporation, New York, N.Y.

[21] Appl. No.: 56,022

[22] Filed: Jul. 9, 1979

[51] Int. Cl.[3] ..... D06M 13/02; D06M 13/10; D06M 15/30

[52] U.S. Cl. ..... 8/115.6; 8/DIG. 9

[58] Field of Search ..... 8/115.6, DIG. 9

[56] References Cited

U.S. PATENT DOCUMENTS

| | | | |
|---|---|---|---|
| 3,049,446 | 8/1962 | Goldstein et al. | 8/185 |
| 3,061,475 | 10/1962 | Lense | 428/290 |
| 3,116,967 | 1/1964 | Goldstein et al. | 8/182 |
| 3,215,556 | 11/1965 | Kehr | 428/513 |
| 3,455,642 | 7/1969 | Solomon | 8/115.6 |
| 3,475,207 | 10/1969 | Berch et al. | 427/392 |
| 3,540,835 | 11/1970 | Marco | 8/115.6 |
| 3,660,303 | 5/1972 | Hiepstand | 8/115.6 |
| 4,028,054 | 6/1977 | North et al. | 8/185 |
| 4,144,176 | 3/1979 | Kawanaka et al. | 8/115.6 |

*Primary Examiner*—Joseph L. Schofer
*Assistant Examiner*—Herbert J. Lilling
*Attorney, Agent, or Firm*—Cynthia Berlow

[57] ABSTRACT

Oxidized $C_{20+}$ alpha-olefins are useful in improving the properties of textiles.

10 Claims, No Drawings

TREATMENT OF TEXTILES WITH MODIFIED ALPHA-OLEFINS

This invention relates to an improved process for treating textiles. More particularly it relates to the improvement of properties of textiles by treating them with oxidized $C_{20+}$ alpha-olefins.

Many attempts have been made to improve the sewability, tear strength, softness, and other properties of textile fabrics. U.S. Pat. No. 3,061,474, for example, teaches treating textiles with an emulsion consisting of a thermosetting resin, water, an emulsifying agent, and a liquid $C_{13}$ to $C_{32}$ branched chain monohydric aliphatic primary alcohol. Oxidized polyethylene-coated cellulosic materials are disclosed in U.S. Pat. No. 3,215,556. U.S. Pat. No. 2,917,412 and No. 3,245,831 show the use of a polyethylene emulsion as a softening agent for textiles. The use of emulsions of high density oxidized polyethylene is taught in U.S. Pat. No. 3,475,207.

These methods have a number of disadvantages; for example, polyethylene is removed to a considerable extent by laundering or dry cleaning, and relatively large amounts must be applied to obtain a substantial improvement in tear strength. The high viscosity and high melting points of both unoxidized and oxidized polyethylene make them difficult to handle.

It has now been found that the disadvantages of the processes of the prior art can be overcome and improved textile products obtained by adding to the padding bath a small amount of an emulsion of an oxidized alpha-olefin having at least 20 carbon atoms.

The starting material for the treating agents of this invention is any alpha-olefin having at least 20, and preferably about 28 to 36, carbon atoms. The upper limit of the number of carbon atoms is restricted only by the availability of the material, and theoretically it could be 300 or more.

The alpha-olefin can be oxidized and emulsified by any known and convenient process. For example, an alpha-olefin is heated to about 110 to 170, and preferably about 130° to 150, ° C., and air is then dispersed in the liquid wax product. The reaction is complete when the desired acid number is reached. Acid numbers ranging from 1 to about 70 are suitable, and the specific acid number selected depends upon the type of emulsion desired, the particle size of the emulsion, the end-use of the emulsion, the type of emulsifier employed, and the like.

Certain of the physical characteristics of these oxidized waxes, e.g., softening point, hardness, surface tackiness, and the like, can be modified for specific end uses by the addition of up to about 100 percent, based on the weight of the oxidized alpha-olefin, of a hard, high melting unoxidized wax. Examples of such waxes include, but are not limited to, polyethylene waxes, Fischer-Tropsch waxes, and other hydrocarbon waxes.

Any suitable ionic or nonionic emulsifier may be used in the amount of about 1 to 50, and preferably about 4 to 30, parts per 100 parts of oxidized alpha-olefin by weight. Examples include, but are not limited to, amine salts of saturated fatty acids, salts of sulfates of fatty alcohols, salts of sulfates of ethoxylated fatty alcohols, acetate salts of long chain aliphatic amines, polyoxyethylene ethers of long chain alcohols, and the like. The emulsion may be made by any wax-to-water method.

The pH of the product emulsion is generally between about 7 and 14, and preferably between about 8 and 9.

The padding bath to which the oxidized alpha-olefin emulsion is added is typically an aqueous or aliphatic alcohol solution of a cross-linking resin, for example, an aminoplast resin, such as dimethylol dihydroxyethylene urea (DMDHEU) or a derivative thereof, triazone formaldehyde resins, urea formaldehyde resins, ethylene urea formaldehyde resins, propylene urea formaldehyde resins, melamine formaldehyde resins, guanamine formaldehyde resins, carbamate resins, uron resins, and the like, and mixtures of these, and a catalyst, such as those set forth in U.S. Pat. No. 3,049,446, No. 3,116,967, No. 3,954,405, and No. 4,028,054.

The amount of oxidized alpha-olefin emulsion that is added to the padding bath is generally about 0.05 to 5.0, and preferably about 0.1 to 2.0, percent, based on the total weight of the bath.

The treating agent of this invention is suitable for use with cellulosic textile fabrics, woven or non-woven, including 100% cellulosic fabrics, e.g., cotton, rayon, and linen, as well as blends, e.g., polyester/cotton and polyester/rayon. Such blends preferably but not necessarily contain at least 20 percent of cellulose. Synthetic materials such as nylons, acrylics, polyesters, polyurethanes, polyolefins, and the like, and mixtures of these materials with each other or with natural fibers may also be treated in accordance with this invention. Both white and colored (printed, dyed, yarn-dyed, cross-dyed, etc.) fabrics can be effectively treated with the system of this invention.

The finishing agents may be applied to the textile fabric in any known and convenient manner, such as by padding or dipping, and will generally be applied from aqueous or alcoholic solution. Other conventional additives such as bodying agents, lubricants, water repellents, flame retardants, soil shedding agents, mildew inhibitors, brighteners, and the like may be included in the treating bath in conventional amounts. Such auxiliaries, however, must not interfere with the proper functioning of the modified alpha-olefin and must not have a deleterious effect on the fabric.

In the process of treating textiles with the compositions of this invention, the textile is impregnated with the solution containing the modified alpha-olefin, and the impregnated textile is then dried and cured; the drying and curing steps may be consecutive or simultaneous.

The compositions of this invention act as a needle lubricant, keeping the needle from melting the fiber during sewing and thereby preventing the formation of holes.

In order that the present invention may be more fully understood, the following examples are given by way of illustration. No specific details contained therein are to be construed as limitations on the present invention except insofar as they appear in the appended claims. Unless otherwise specified, all parts and percentages are by weight.

Tear Strength is measured by ASTM Test Method #D-1424 (the Elmendorf falling pendulum type), and is reported as the number of grams required to start the tear.

Sewability is measured by counting the cut threads after sewing with a high-speed commercial sewing machine and is reported as the number of cut threads per inch.

Flex abrasion is measured by ASTM Test Method #D-1175, Flexing and Abrasion, and is reported as the number of cycles of flex abrasion before the fabric is cut.

EXAMPLE I (A) 100 Parts of a $C_{30+}$ alpha-olefin was heated to 140° C. Air was then dispersed in the liquid wax product. The temperature was maintained at 150° C. for one hour and then lowered to 140° C. for the remainder of the oxidation in order to minimize degradation of the wax. The reaction was stopped when the acid number reached 33.

(B) 100 Parts of the oxidized alpha-olefin was mixed with 25 parts of a twelve mole ethoxylate of a 12 carbon atom secondary alcohol (available from Union Carbide as Tergitol 25-L-12) and heated to 125°±5° C. 6.83 Parts of 45% aqueous caustic potash was added slowly, allowing excess water to boil off. The mixture was stirred at 125°±5° C. for 30 seconds and then poured into 365 parts of water at 90°±5° C. with vigorous agitation, not permitting the mixture to boil. The mixture was stirred at 90°±5° C. for one minute and then cooled rapidly to 30° C. The solids was adjusted with water to 26±1% and the pH was adjusted with dilute acetic acid to 8.5±0.5.

(C) A padding bath containing 11 parts of a 45% aqueous solution of dimethylol dihydroxyethylene urea (DMDHEU), 4 parts of activated magnesium chloride catalyst, 2 parts of the oxidized alpha-olefin of part (B), and 83 parts of water was prepared.

(D) Samples of 80×80 cotton were impregnated with (1) the solution of part (C) above, (2) a padding bath containing only DMDHEU, magnesium chloride, and water, and (3) water.

In each case the fabric was then dried for 3 minutes at 95° C., cured for 15 seconds at 160° C., and the properties determined. The results are tabulated below:

| | Sewability Needle Size | | Tear | | Flex Abrasion | |
|---|---|---|---|---|---|---|
| Sample | .040 | .049 | Warp | Fill | Warp | Fill |
| (1) | 1.8 | 7.3 | 650 | 350 | 701 | 1021 |
| (2) | 15.7 | 21.0 | 400 | 200 | 148 | 209 |
| (3) | 12.0 | 16.0 | 500 | 450 | 477 | 368 |

From these data it can be seen that the properties of samples treated with a padding bath plus the products of this invention were superior to those of samples treated with a padding bath without the oxidized alpha-olefin of this invention.

EXAMPLE 2

The procedure of Example 1 (D) was repeated with cotton knit instead of 80×80 cotton. The results are tabulated below:

TABLE II

| Sample | Sewability Needle Size .049 |
|---|---|
| (1) | 1.8 |
| (2) | >40 (too large to count) |
| (3) | 20.8 |

The sewability of the fabric treated with a padding bath containing the product of this invention was considerably better than that of the fabric treated with a bath not containing an oxidized alpha-olefin.

EXAMPLE 3

The procedure of Example 1 was repeated except that a $C_{24}$ alpha-olefin and a $C_{20}$ alpha-olefin were used instead of a $C_{30+}$ alpha-olefin. The results are tabulated below, wherein the $C_{24}$ product is (4), the $C_{20}$ product is (5), and (2) and (3) are the same as above:

TABLE III

| | Sewability | Tear | | Flex Abrasion | |
|---|---|---|---|---|---|
| Sample | Needle Size .049 | Warp | Fill | Warp | Fill |
| (4) | 10.1 | 400 | 300 | 633 | 404 |
| (5) | 22.7 | 400 | 250 | 189 | 224 |
| (2) | 21.0 | 400 | 200 | 148 | 209 |
| (3) | 16.0 | 500 | 450 | 477 | 368 |

From these data it can be seen that the properties of a fabric treated with a padding bath containing an oxidized $C_{24}$ alpha-olefin are considerably better and those of a fabric treated with a padding bath containing an oxidized $C_{20}$ alpha-olefin are about equal to or slightly better than those of a fabric treated with a composition not containing an oxidized alpha-olefin.

EXAMPLE 4

The procedure of Example 3 was repeated with cotton knit instead of 80×80 cotton. The results are tabulated below:

TABLE IV

| Sample | Sewability Needle Size .049 |
|---|---|
| (4) | 3.0 |
| (5) | 17.0 |
| (2) | >40 |
| (3) | 20.8 |

The sewability characteristics of the fabric treated with a composition containing an oxidized $C_{20}$ and an oxidized $C_{24}$ alpha-olefin were superior to those of the fabrics treated with a composition that did not contain an oxidized alpha-olefin.

In each of the above examples the hand of the fabric was improved when the padding bath contained an oxidized alpha-olefin and the fabric did not yellow.

EXAMPLE 5

(A) The performance of an oxidized $C_{30+}$ alpha-olefin emulsion (a) in treating 80×80 cotton fabric was compared with that of an oxidized polyethylene emulsion (b). The results are tabulated below:

TABLE V

| | Sewability | Tear | | Flex Abrasion | |
|---|---|---|---|---|---|
| Sample | Needle Size .049 | Warp | Fill | Warp | Fill |
| (a) | 7.3 | 650 | 350 | 701 | 1021 |
| (b) | 8.2 | 650 | 300 | 658 | 711 |

(B) The properties of oxidized $C_{30+}$ alpha-olefin (a) were compared with those of oxidized polyethylene (b), unoxidized $C_{30+}$ alpha-olefin (c), and unoxidized polyethylene (d). They are tabulated below:

TABLE VI

| | (a) | (b) | (c) | (d) |
|---|---|---|---|---|
| Softening Point °C. (ASTM-E-28) | 72 | 104 | 72 | 106 |
| Hardness, dmm (ASTM-D-5) | 35 | 5.5 | — | 3.5 |

TABLE VI-continued

| | (a) | (b) | (c) | (d) |
|---|---|---|---|---|
| Density, g./cc. (23° C.) | 0.96 | 0.93 | — | 0.92 |
| Viscosity, cps (140° C.) (Brookfield) | 37 | 200 | 15 | 200 |
| Acid Number, mg. KOH/g. | 35 | 15 | nil | nil |

From the above data it can be seen that, although the performance of the emulsion of this invention is equivalent to that of an oxidized polyethylene emulsion, there are advantages to the use of oxidized $C_{20+}$ alpha-olefins. Because of its lower viscosity, the alpha-olefin is easier to handle than the polyethylene, and much less horsepower is required to disperse into it the air that is necessary for oxidation.

EXAMPLE 6

The procedure of Example 1 was repeated with each of the following fabrics instead of cotton: 50/50 polyester/cotton, 65/35 polyester/cotton, 50/50 polyester/rayon, 65/35 polyester/rayon, 100% nylon, 100% polyester, and 100% polyurethane. The results were comparable.

EXAMPLE 7

The procedure of Example 1(c) was repeated with the following amounts of oxidized alpha-olefin emulsion in the padding bath instead of 2 parts: 0.5, 1, 3, and 5 parts. The results were comparable.

EXAMPLE 8

The procedure of Example 1(A) was repeated to an acid number of each of the following instead of 33: 18, 24, 28, 30, 35, 38, 40, 45, and 50. The results were comparable.

EXAMPLE 9

The procedure of Example 1(C) was repeated with each of the following instead of DMDHEU: partially methylated DMDHEU, methylated DMDHEU, uron resin, triazone formaldehyde resin, urea formaldehyde resin, ethylene urea formaldehyde resin, propylene urea formaldehyde resin, carbamate resin, and melamine formaldehyde resin. The results were comparable.

EXAMPLE 10

The procedure of Example 1(C) was repeated with each of the following catalysts instead of activated magnesium chloride: zinc chloride, zinc nitrate, magnesium nitrate, aluminum sulfate, aluminum chloride, and zinc fluoroborate. The results were comparable.

EXAMPLE 11

The procedure of Example 1(C) was repeated with each of the following solvents instead of water: methanol, ethanol, and isopropanol. The results were comparable.

EXAMPLE 12

The modification of the softening points of oxidized alpha-olefins is illustrated in the following tables. Table VII shows an oxidized $C_{20-24}$ alpha-olefin, Table VIII an oxidized $C_{24-28}$ alpha-olefin, and Table IX an oxidized $C_{30+}$ alpha-olefin. In each the softening point was determined by ASTM Method E-28 and the unoxidized wax adducts were (a) a 1000 molecular weight homopolymer of ethylene, m.p. 113° C. (Bareco 1000 Polywax available from the Bareco Division of Petrolite Corporation), (b) a 2000 molecular weight homopolymer of ethylene, m.p. 125° C. (Bareco 2000 Polywax), and (c) a 750 molecular weight Fischer-Tropsch wax (Paraflint available from Moore & Munger Inc.).

TABLE VII

| | Softening Point, °C. ($C_{20-24}$) | | |
|---|---|---|---|
| % Adduct | (a) | (b) | (c) |
| 0 | 62 | 62 | 62 |
| 2 | 62 | 111 | 65 |
| 5 | 101.5 | 114 | 91 |
| 10 | 106 | 117 | 103 |
| 20 | 109 | 118.5 | 110 |
| 100 | 113 | 125 | 110 |

TABLE VIII

| | Softening Point, °C. ($C_{24-28}$) | | |
|---|---|---|---|
| % Adduct | (a) | (b) | (c) |
| 0 | 65 | 65 | 65 |
| 2 | 68.5 | 102 | 74 |
| 5 | 97.5 | 112 | 87 |
| 10 | 104 | 116 | 99 |
| 20 | 107 | 119 | 108.5 |
| 100 | 113 | 125 | 110 |

TABLE IX

| | Softening Point, °C. ($C_{30+}$) | | |
|---|---|---|---|
| % Adduct | (a) | (b) | (c) |
| 0 | 71.5 | 71.5 | 71.5 |
| 1 | 73 | 84 | 71.5 |
| 1.25 | 73 | 104 | 71.5 |
| 1.67 | 74 | 108 | 71.5 |
| 2 | 85.5 | 110 | 81 |
| 3 | 104 | 116 | 81 |
| 4 | 107 | 117 | 81 |
| 5 | 107.5 | 117.5 | 92 |
| 10 | 110 | 120.5 | 108 |
| 20 | 110.5 | 121.5 | 110 |
| 100 | 113 | 125 | 110 |

In addition to raising the softening points, the addition of the unoxidized wax increased the hardness and lowered the surface tackiness of the oxidized alpha-olefins.

EXAMPLE 13

The procedures of Examples 1 through 4 were repeated except that the padding baths also contained unoxidized waxes in varying amounts, based on the weight of the oxidized alpha-olefins, as follows: 1, 3, 10, and 100 percent of a 1000 molecular weight homopolymer of ethylene; 1, 3, 10 and 100 percent of a 2000 molecular weight homopolymer of ethylene; and 1, 2, 5, 10, and 100 percent of a 750 molecular weight Fischer-Tropsch wax. The results were comparable.

From the foregoing it is clear that the inclusion of a small amount of an oxidized $C_{20+}$ alpha-olefin emulsion in a resin padding bath not only facilitates the application of the composition to textile materials but also imparts desirable characteristics to the fabric, such as softness, tear strength, abrasion resistance, sewability, hand, and the like without a deleterious effect on its durable-press properties and without undesirable yellowing of white fabrics.

What is claimed is:

1. In a process for treating textiles comprising impregnating a textile with a solution of a cross-linking aminoplast resin and a textile resin catalyst, the improvement wherein the solution contains about 0.05 to 5.0 percent, based on the weight of the solution, of an emulsion of an oxidized alpha-olefin having at least 20 carbon atoms, said oxidized alpha-olefin having an acid number of about 1 to about 70.

2. The improvement of claim 1 wherein the alpha-olefin has about 28 to 36 carbon atoms.

3. The improvement of claim 1 wherein the amount of oxidized alpha-olefin emulsion is about 0.1 to 2.0 weight percent.

4. The improvement of claim 1 wherein the pH of the emulsion is about 7 to 14.

5. The improvement of claim 1 wherein the solution additionally contains up to about 100 percent, based on the weight of the oxidized alpha-olefin, of a hard, high melting unoxidized wax.

6. A padding bath for textiles which comprises an aqueous or alcoholic solution of a cross-linking aminoplast resin, a textile resin catalyst, and about 0.05 to 5.0 percent, based on the weight of the solution, of an emulsion of an oxidized alpha-olefin having at least 20 carbon atoms, said oxidized alpha-olefin having an acid number of about 1 to about 70.

7. The padding bath of claim 6 wherein the alpha-olefin has about 28 to 36 carbon atoms.

8. The padding bath of claim 6 which additionally contains up to about 100 percent based on the weight of the oxidized alpha-olefin, of a hard, high melting unoxidized wax.

9. A process for improving the properties of textiles which comprises impregnating a textile with the solution of claim 6.

10. A textile produced by the process of claim 9.

* * * * *